US010168054B2

(12) United States Patent
Amati et al.

(10) Patent No.: US 10,168,054 B2
(45) Date of Patent: Jan. 1, 2019

(54) CONTROL DEVICE FOR GAS OVENS

(71) Applicant: ACTEK S.R.L., Cassago Brianza (Lecco) (IT)

(72) Inventors: Carlo Amati, Cassago Brianza (IT); Enrico Amati, Cassago Brianza (IT)

(73) Assignee: ACTEK S.R.L., Cassago Brianza (IT)

( * ) Notice: Subject to any disclaimer, the term of this patent is extended or adjusted under 35 U.S.C. 154(b) by 270 days.

(21) Appl. No.: 15/132,634

(22) Filed: Apr. 19, 2016

(65) Prior Publication Data

US 2017/0299193 A1 Oct. 19, 2017

(51) Int. Cl.
*F24C 3/12* (2006.01)
*F23N 1/00* (2006.01)

(52) U.S. Cl.
CPC ..... *F24C 3/128* (2013.01); *F23N 1/005* (2013.01)

(58) Field of Classification Search
CPC ..... F24C 3/128
USPC ..... 236/15 A
See application file for complete search history.

(56) References Cited

U.S. PATENT DOCUMENTS 3,559,884 A * 2/1971 Visos ..... F23N 5/107 137/489
3,575,542 A * 4/1971 Branson ..... F23N 1/00 236/15 A
3,729,131 A * 4/1973 McGowan ..... F24C 3/12 137/614.16
3,779,383 A * 12/1973 Ayres ..... G01N 33/491 210/789
4,480,628 A * 11/1984 Simpson ..... A21B 1/52 126/21 A
5,425,631 A * 6/1995 Krueger ..... F23N 5/203 236/15 A
5,816,490 A * 10/1998 Areso ..... F23N 1/005 236/15 A
5,937,846 A * 8/1999 Martin ..... F23N 1/007 126/39 E
2002/0023648 A1* 2/2002 Komesaroff ..... A61M 16/10 128/205.25
2005/0109969 A1* 5/2005 Turnau, III ..... F16K 31/60 251/304

(Continued)

FOREIGN PATENT DOCUMENTS

AT 508263 A4 12/2010
DE 1778449 A1 9/1971
DE 102011100182 A1 10/2012

*Primary Examiner* — Henry Crenshaw
(74) *Attorney, Agent, or Firm* — Shuttleworth & Ingersoll, PLC; Timothy Klima

(57) ABSTRACT

A control device for gas ovens, including: a valve body exhibiting an inlet opening for combustible gas and an outlet opening for combustible gas; a passage conduit for passage of the gas, fashioned internally of the valve body for setting the inlet opening in fluid communication with the outlet opening; a selector device associated with the valve body and exhibiting at least one shutter for at least partly interfering in the gas passage conduit and defining a reduction or interruption of the section for passage of the fluid in the conduit; the valve body including at least one sliding channel for the shutter, the sliding channel being made as a single body with the valve body and in communication with the gas passage conduit, the selector device being coupled to the sliding channel.

9 Claims, 4 Drawing Sheets

(56) References Cited

U.S. PATENT DOCUMENTS

2007/0144589 A1* 6/2007 Huang ..... F23N 1/005
137/601.14

* cited by examiner

CONTROL DEVICE FOR GAS OVENS

The object of the present invention is a control device for gas ovens, particularly for gas oven burners.

As is known, gas ovens are equipped with a thermostat that measures the internal temperature of the oven so as to reduce the flow rate of gas flowing to the burner when the temperature detected reaches a pre-determined value.

As a result, the oxidation-reduction reaction inside the burner takes place with a smaller amount of gas, leading to a decrease in the amount of thermal energy developed and thus to the lowering of the oven temperature.

In order to realize this process, the ovens of the prior art utilize control units substantially constituted by a plurality of valves and a number of pneumatic circuits.

These control units also provide for total interruption of the gas flow in the event in which the burner must be turned off, such as in the case of an emergency or malfunctioning of the system.

In particular, according to a first prior-art technique, in order to ensure the maximum flow rate of the gas, a valve is operatively associated with a conduit having an inlet and an outlet for the combustible gas, whereas the minimum flow rate of the gas is realized by an independent circuit that comprises another valve associated with another conduit having an outlet and an inlet for the gas. In this manner, when the oven is turned on, the valves controlling the maximum and minimum flow rate are open and the gas reaches the burner. When the oven reaches the pre-established temperature, the maximum flow rate valve closes, whereas the minimum flow rate valve remains open. In the event of malfunctioning or significant critical states, the valves shut, stopping delivery of the fluid.

However, these control systems have a significant drawback originating from the particularly cumbersome and hardly compact structure as it is constituted by a number of structurally independent bodies.

According to a second prior-art technique, there is comprised a single valve body inside of which the main maximum flow rate conduit and the auxiliary minimum flow rate conduit are afforded.

The valve body has holes for housing the valves, which are screwed or engaged to the valve body by means of suitable constraining means.

Although they are compact in that they are provided with a single body for housing the two conduits, such systems are, in any case, improvable as regards various aspects.

Firstly, it should be considered that the individual valves (constituted by thermostatic solenoid valves) have a set of components that are individually coupled to the valve body, such as each shutter's sliding seat, which is constituted by a cap found inside the respective seat afforded in the valve body.

The internal structure of the shutter, comprising movement springs and fluid sealing gaskets, also implies the need for arduous assembly procedures apt for definition of the entire device.

A further drawback of this prior-art technique consists in the complexity of the valve body in its application inside an oven, which, according to the latest production trends, has increasingly smaller spaces for housing the safety systems.

In this context, the technical task underlying the present invention is to devise a control device for gas ovens that is capable of resolving the drawbacks cited hereinabove.

In particular, the aim of the present invention is to realize a control device that is compact, hardly cumbersome and that offers easy maintenance.

Furthermore, another aim of the present invention is to make available a control device that is structurally simple, with limited costs, and that is versatile and capable of being applied to respective ovens simply and economically.

The technical task and the specified aim are substantially achieved by a control device for gas ovens including one or more of the technical solutions disclosed herein.

By way of approximate and non-limiting example, a description is provided of a preferred, but not exclusive, embodiment of a control device for gas ovens illustrated in the accompanying drawings, of which:

Figure 1:
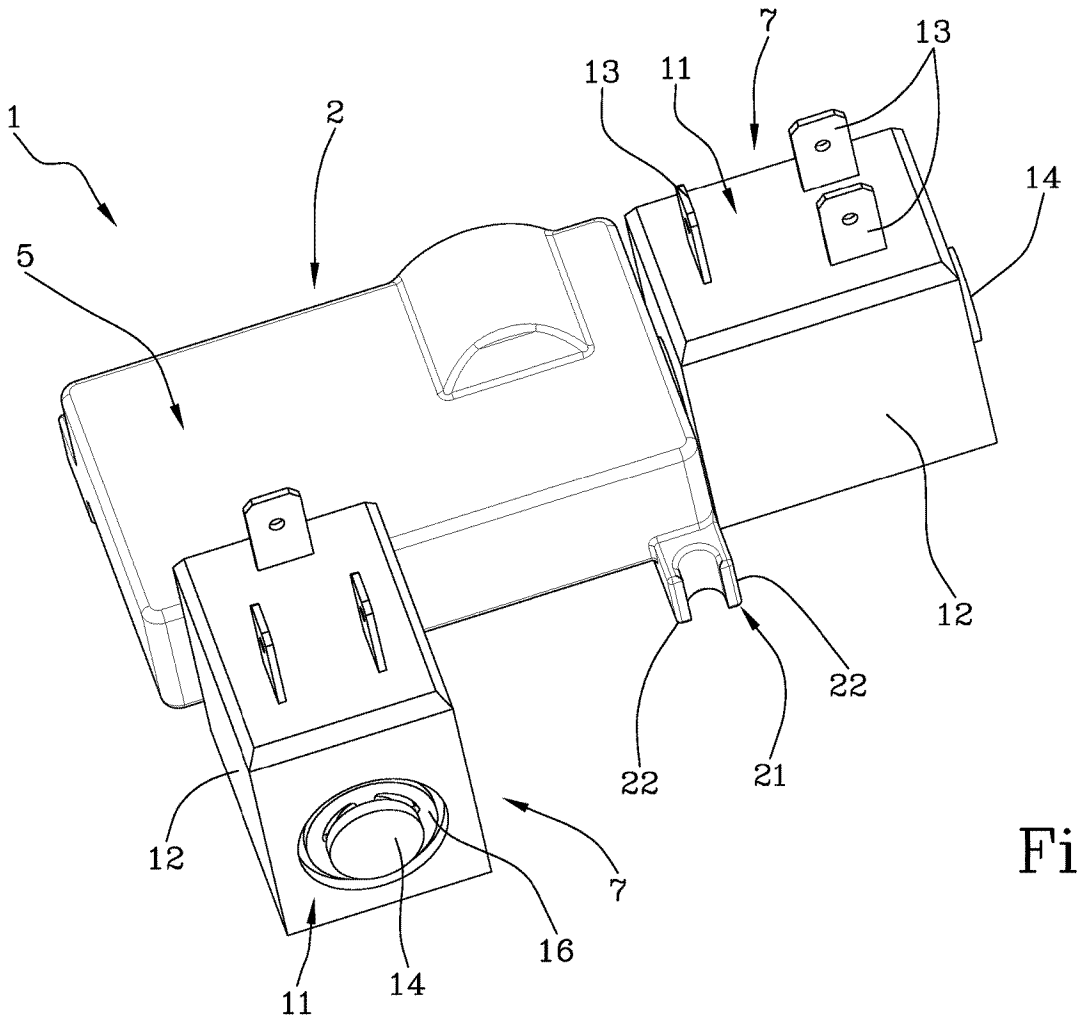
FIG. 1 is a perspective view of the control device for gas ovens according to the present invention.

With reference to the accompanying figures, a control device for gas ovens is indicated in its entirety by the number 1.

In particular, the device 1 comprises a valve body 2 having an inlet opening 3 for combustible gas and an outlet opening 4 for combustible gas.

The valve body 2 is preferably constituted by a main element 5 realized as a monobloc element, having a substantially parallelepiped conformation with a rectangular section. It should be specified that the main element 5 may be of any shape and dimensions, based on various production needs. Purely by way of example and for the sake of simplification, the main element 5 is illustrated in the form of a parallelepiped in the accompanying figures.

In further detail, the inlet and outlet openings 3, 4 respectively define a seat for connecting users (unillustrated as they are not part of the present invention) to the gas outlet opening 3, and a seat for connecting a delivery line to the gas inlet opening 4. The openings 3, 4 advantageously flank each other and are fashioned on the same surface of the main element 5. As shown in the accompanying figures, the openings 3, 4 are afforded on a smaller lateral face of the above-mentioned main element 5.

Note that in this manner the position of the openings 3, 4 on the main element 5 defines connection seats parallel to each other and located on one side of the valve body 2.

Figure 4:
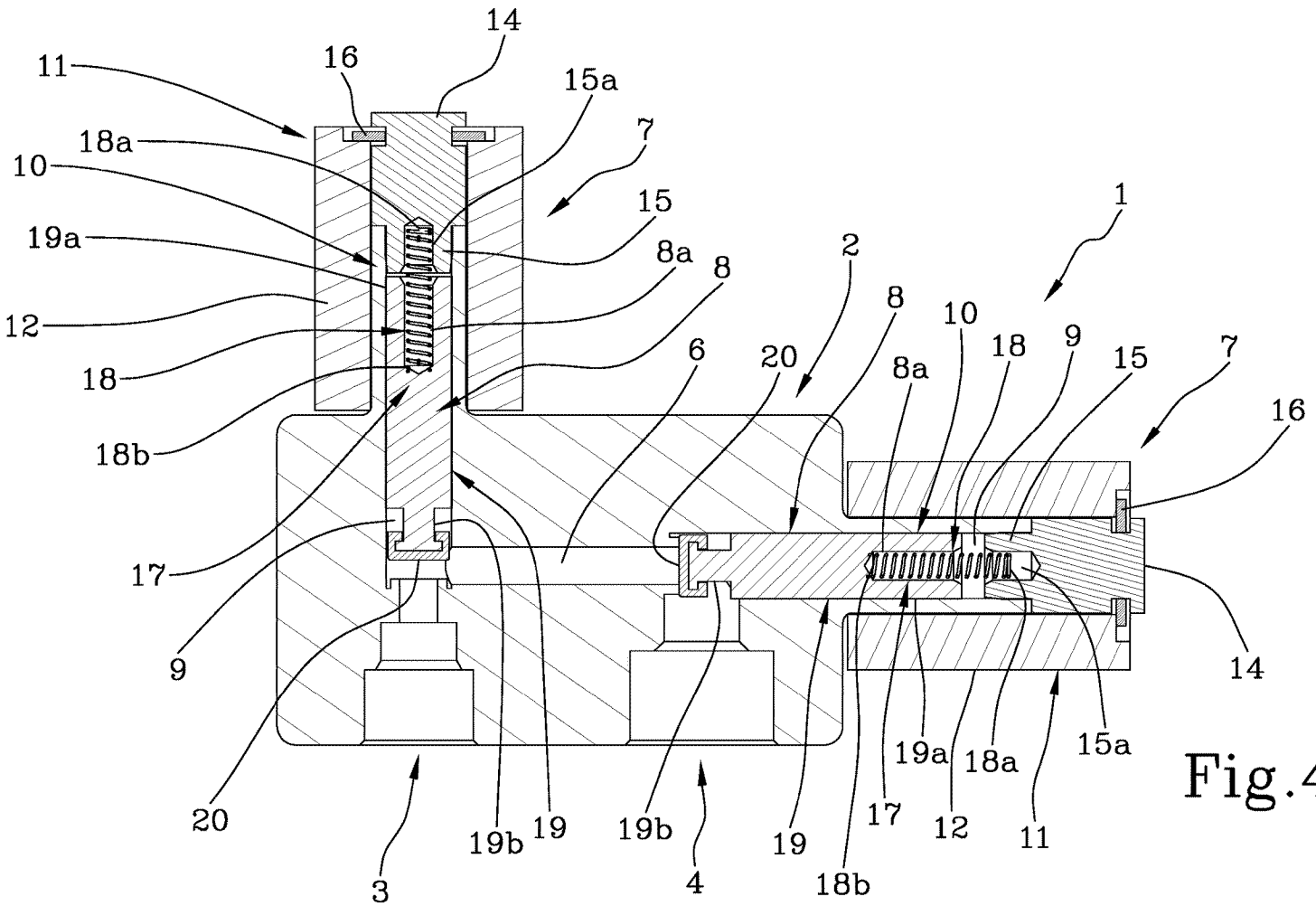
FIG. 4 is a sectional view of the device according to the present invention, taken along line III-III of FIG. 3.

As illustrated more clearly in FIG. 4, the valve body 2 has an internal passage conduit 6 for passage of the gas and that is apt for setting the inlet opening 3 in fluid communication with the output opening 4. The conduit 6 extends perpendicularly to the inlet and outlet direction of the gas in the respective openings 3, 4.

The device 1 further comprises selector means 7 associated with the valve body 2 and exhibiting at least one shutter 8 for at least partly interfering in the gas passage conduit 6 and defining a reduction or interruption of the fluid passage section.

More specifically, the shutter 8 is movable inside a respective sliding channel 9 so as to occlude the passage conduit 6 at least partially.

Advantageously, the sliding channel 9 is made as a single body with the valve body 2 and is set in fluid communication with the gas passage conduit 6.

In this situation, it should be noted that the selector means 7 is directly coupled to the sliding channel 9.

In accordance with current regulations requiring maximum safety in combustible gas control devices, two shutters 8 suitable for occluding the conduit 6 are provided and in the conduit 6, each shutter 8 is slidably housed in a respective channel 9. The presence of the two shutters 8 thus ensures proper functioning of the device even in the case of malfunctioning of one of the movement systems of the shutter 8.

In further detail, each sliding channel 9 is defined by a tubular projection 10 extending from a lateral surface of the main element 5. In the example embodiment illustrated in the accompanying figures, the tubular projections 10 emerge from adjacent lateral surfaces of the main element 5 and in particular from a larger lateral surface and from a smaller lateral surface. In this case as well, the tubular projection 10, and thus the sliding channel 9 of the shutter 8, may be positioned in any manner, based on various production and utilisation needs.

Note that the main element 5 and the tubular projections 10 are advantageously made as a single piece and thus define a single body that can be obtained by means of suitable moulding procedures.

It should also be noted from the sectional view in FIG. 4 that each channel 9 is in communication with the passage conduit 6 at a respective opening 3, 4 so as to intervene with the shutters 8 in different positions with respect to each other and near the gas inlet or outlet.

The selector means 7 comprises a pair of valves 11, each of which is fitted about a respective tubular projection 10.

In particular, the valves 11 are solenoid valves commanded by a thermostat, which is not illustrated as it is of a known type and not part of the present invention.

Each valve 11 exhibits a solenoid group 12 having a substantially cylindrical conformation and that is designed to be fitted about a respective tubular projection 10.

Each solenoid group 12 is preferably square in section and internally has the solenoid (unillustrated in the accompanying figures as it is of a known type) that is active by magnetic effect on the respective shutter 8.

Additionally, the respective electrical connectors 13 extend from the solenoid group 12, for electrical connection with the above-mentioned thermostat.

Each valve 11 further comprises a closing element 14 associated internally of the solenoid group 12 and developing along the longitudinal development of the respective tubular projection 10.

More specifically, again referring to the sectional view of FIG. 4, each closing element 14 has a substantially cylindrical conformation and is provided with a smaller-section portion 15 that is insertable by mechanical interference internally of the channel 9 defined by the tubular projection 10.

In other words, the smaller-section portion 15 is snap-fit inside the channel 9 so as to couple the element 14 stably onto the tubular projection 10. This mechanical jointing is implemented by suitably dimensioning the section of the portion 15 with the lune of the passage of the channel 9.

Note also that the closing element 14 is stably engageable to the solenoid group 12 so as to anchor this solenoid group 12 to the tubular projection 10 as well. The coupling between the closing element 14 and the group 12 preferably takes place by means of the interposition of an elastic sealing ring 16, such as a Seeger ring.

Each valve 11 further comprises movement means 17 for moving the shutter 8, arranged internally of the tubular projection 10 and interposed between the closing element 14 and the shutter 8.

In further detail, the movement means 17 is constituted by a spring 18 having a first end 18*a* that is at least partly housed in a cavity 15*a* fashioned in the cap 14, and a second end 18*b* that is opposite the first end 18*a* and at least partly housed in a cavity 8*a* fashioned in the shutter 8.

The cavity 15*a* is preferably fashioned on the smaller-section portion 15 of the closing element 14. Furthermore, the two cavities 15*a* and 8*a* prove to face each other so as to contain the above-mentioned spring 18.

Note that in this situation the shutter 8 comprises a cursor (slide) 19 that has a substantially cylindrical conformation (shape) and exhibits a first end 19*a* in which said cavity 8*a* for containing the second end 18*b* of the spring 18 is housed, and a second end 19*a* apt for interfering internally of the passage conduit 6.

The second end 19*b* of the cursor 19 comprises a seal 20 coupled by mechanical jointing to the second end 19*b*.

Note that both cursors 19 are slidable inside the channel 9 between two extreme positions corresponding to the open or closed operating configuration. In particular, when the cursor 19 is completely close to the closing element 14 (by effect of the magnetic action implemented by the solenoid group 12), the respective second end 19*b* equipped with the seal 20 proves to be moved away from the channel 6 so as to enable passage of fluid in the conduit.

However, when the cursor 19 is moved away from the closing element 14 (by effect of the elastic action of the spring 18), the respective second end 19*b* equipped with the seal 20 proves to be arranged in the passage section of the conduit 6 so as to occlude the conduit 6 and prevent the passage of fluid. Between the two extreme conditions (totally open or totally closed) of the cursor 19, a plurality of intermediate conditions can be implemented, representing partial blockage of the conduit 6 and defining a limitation of the passage of gas.

These intermediate conditions can thus define a minimum gas flow rate inside the conduit 6, whereas the open configuration of the cursor 19 (position of the cursor 19 is close to the closing element 14) defines the maximum gas flow rate.

Advantageously, the device 1 further comprises a plurality of a plurality of fastening protuberances 21 emerging from the main element 5 and made as a single piece with the element 5 so as to be engageable to a structure of the gas oven.

Figure 2:
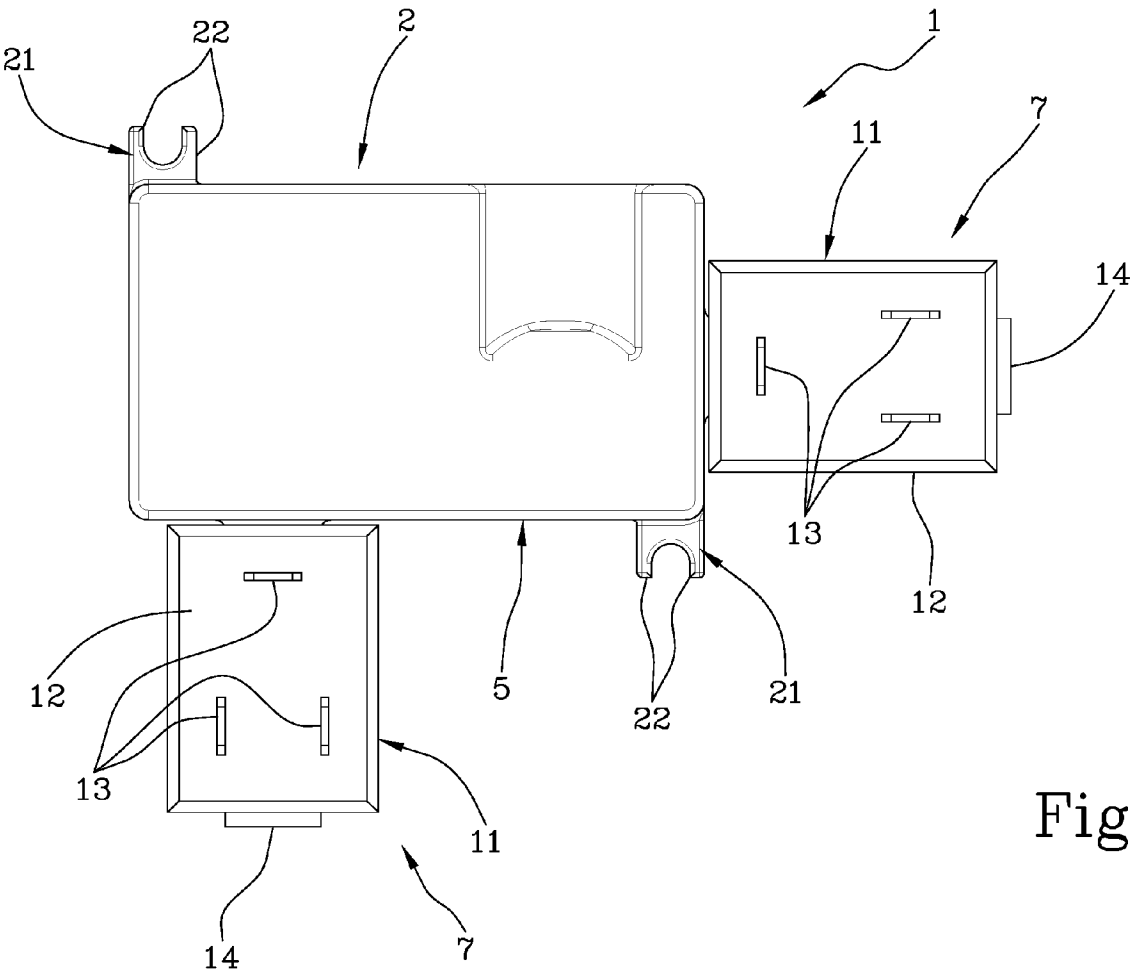
FIG. 2 is a plan view of the control device appearing in FIG. 1.
Figure 3:
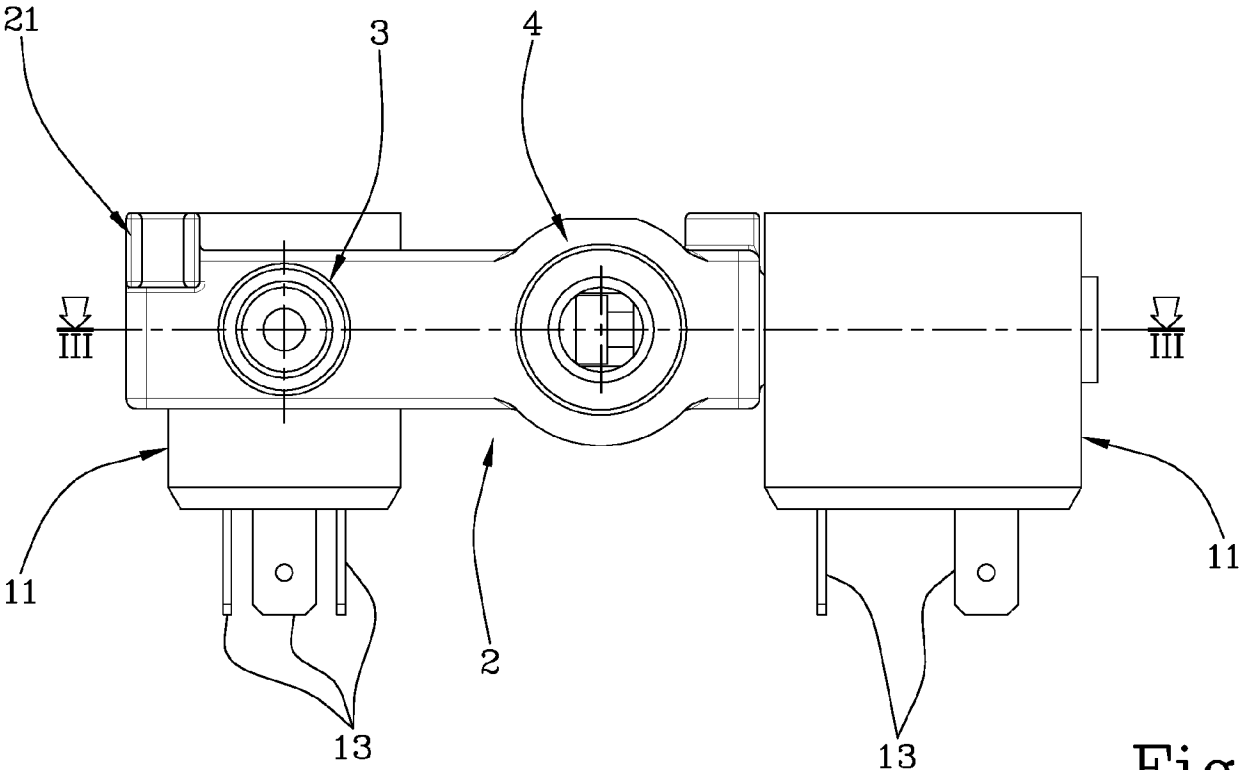
FIG. 3 is a side elevation of the device of FIG. 1.

As illustrated more clearly in FIGS. 1 and 2, the fastening protuberances 21 are constituted by elastic tabs 22 apt for defining a snap attachment with the supporting frame of the oven in which the device 1 is engaged.

Note that the control device 1 for gas ovens according to the present invention enables the aims stated hereinabove to be achieved.

In fact, owing to the monobloc structure of the valve body 2, and particularly the realization of the main element 5 as a single piece with the tubular projections 10 and with the fastening protuberances 21, it defines a very compact structure that is hardly cumbersome and thus easy and economical to realize.

Note for example that there is no need to add further elements to the main body 5, such as elements apt for housing the valve cursor 8.

The coupling of the valve 11 to the tubular element 10 (and thus to the entire monobloc structure of the valve body 2) also takes place by simple mechanical jointing implemented by the closing element 14. As a result, there is no need to provide additional engagement elements or special machining such as thread-forming to facilitate coupling between the valve and the body.

The structure of the closing element 14 and the cursor 19, which have integral housing seats for the spring 18, also makes it possible to simplify and thus render the structure of the movement elements of the cursor 19 more economical.

Lastly, note that the device 1 proves to be versatile and easy to apply owing to the presence of the protuberances 21 integrated in the valve body 2 and owing to the parallel arrangement of the gas inlet 3 and outlet 5.

The invention claimed is:

1. A control device for a gas oven, comprising:

a valve body including a main element having a substantially parallelepiped shape with a rectangular section, an inlet opening for combustible gas, and an outlet opening for the combustible gas;

a gas passage conduit for the combustible gas, positioned internally of the valve body for placing the inlet opening in fluid communication with the outlet opening; and a selector device coupled to the valve body, the selector device including two shutters for at least partly interfering in the gas passage conduit to define a reduction or interruption of a fluid passage section in the gas passage conduit;

the valve body including internally two sliding channels, each of the two sliding channels receiving a respective one of the two shutters and being in communication with the gas passage conduit, the selector device being coupled to each of the two sliding channels;

each of the two sliding channels comprising a tubular projection extending from a respective lateral surface of the main element;

the selector device comprising two valves, each of the two valves comprising a solenoid group having a substantially cylindrical shape and fitted around a respective one of the tubular projections;

each of the two valves further comprising a closing element positioned internally of the solenoid group and extending along a longitudinal direction of the respective one of the tubular projections for closing an inlet to a respective one of the two sliding channels;

each of the two valves further comprising an elastic member for biasing the respective one of the two shutters, the elastic member arranged internally of the respective one of the tubular projections and interposed between a respective one of the closing elements and the respective one of the two shutters.

2. The control device according to claim 1, wherein a first one of the two sliding channels is in communication with the gas passage conduit at the inlet opening and a second one of the two sliding channels is in communication with the gas passage conduit at the outlet opening.

3. The control device according to claim 1, wherein the elastic member comprises a spring having a first end at least partly housed in a cavity fashioned in the respective one of the closing elements and a second end opposite the first end, the second end being at least partly housed in a cavity fashioned in the respective one of the two shutters.

4. The control device according to claim 3, wherein each shutter comprises a slide having a substantially cylindrical shape and including a first end defining the cavity in which the second end of the spring is housed, and a second end for interfering internally of the gas passage conduit.

5. The control device according to claim 4, wherein the second end of the slide comprises a seal mechanically joined to the second end.

6. The control device according to claim 1, wherein each closing element includes a smaller section portion positioned in a portion of the respective one of the two sliding channels defined by the tubular projection, the smaller section portion being retained in the portion of the respective one of the two sliding channels by mechanical interference.

7. The control device according to claim 1, wherein the outlet opening provides a connection for attaching a gas user to the control device and the inlet opening provides a connection for attaching a gas supply to the control device, the inlet opening and the outlet opening being positioned side by side on a same surface of the main element to define connections that are parallel to one another.

8. The control device according to claim 1, and further comprising a plurality of fixing protuberances extending from the main element and made in a single piece with the main element so as to be engageable to a structure of the gas oven.

9. The control device of claim 1, wherein each solenoid group is controlled by a thermostat.

* * * * *